US011269368B2

(12) United States Patent
Al-Shyoukh et al.

(10) Patent No.: US 11,269,368 B2
(45) **Date of Patent: *Mar. 8, 2022**

(54) FLIPPED GATE VOLTAGE REFERENCE AND METHOD OF USING

(71) Applicant: TAIWAN SEMICONDUCTOR MANUFACTURING COMPANY, LTD., Hsinchu (TW)

(72) Inventors: Mohammad Al-Shyoukh, Cedar Park, TX (US); Alex Kalnitsky, San Francisco, CA (US)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 710 days.

This patent is subject to a terminal disclaimer.

(21) Appl. No.: 14/182,810

(22) Filed: Feb. 18, 2014

(65) Prior Publication Data

US 2015/0234413 A1 Aug. 20, 2015

(51) Int. Cl.
*G05F 3/26* (2006.01)
*G05F 3/24* (2006.01)

(52) U.S. Cl.
CPC ..... *G05F 3/262* (2013.01); *G05F 3/24* (2013.01)

(58) Field of Classification Search
CPC ... G05F 3/24; G05F 3/26; G05F 3/262; G05F 3/20; G05F 3/02; G05F 3/08; G05F 3/16; G05F 3/10; G05F 3/30
USPC ..... 323/313, 315
See application file for complete search history.

(56) References Cited

U.S. PATENT DOCUMENTS 6,831,505 B2 * 12/2004 Ozoe ..... G05F 3/245 323/313
10,241,535 B2 * 3/2019 Al-Shyoukh ..... G05F 3/26
2003/0227322 A1 12/2003 Ozoe
2005/0218968 A1 10/2005 Watanabe
(Continued)

FOREIGN PATENT DOCUMENTS

CN 101361268 2/2009
CN 103092239 5/2013
(Continued)

OTHER PUBLICATIONS

Office Action dated Dec. 22, 2015 and English translation from corresponding No. KR 10-2014-0165519.
(Continued)

*Primary Examiner* — Nguyen Tran
(74) *Attorney, Agent, or Firm* — Hauptman Ham, LLP

(57) ABSTRACT

A voltage reference includes a flipped gate transistor configured to receive a first current. The voltage reference further includes a first transistor configured to receive a second current, the first transistor having a first leakage current, wherein the first transistor is connected with the flipped gate transistor in a Vgs subtractive arrangement. The voltage reference further includes an output node configured to output a reference voltage, the output node connected to the first transistor. The voltage reference further includes a second transistor connected to the output node, the second transistor having a second leakage current, wherein the first leakage current is substantially equal to the second leakage current.

20 Claims, 5 Drawing Sheets

(56) References Cited

U.S. PATENT DOCUMENTS

| | | | | |
|---|---|---|---|---|
| 2007/0285153 | A1* | 12/2007 | Hasegawa | H03K 19/00361 327/543 |
| 2008/0233694 | A1* | 9/2008 | Li | H01L 21/28194 438/216 |
| 2011/0121888 | A1* | 5/2011 | Giotta | G05F 3/262 327/538 |
| 2013/0063103 | A1* | 3/2013 | Samid | G05F 1/56 323/268 |
| 2013/0099315 | A1* | 4/2013 | Zhu | H01L 29/66742 257/347 |
| 2013/0106394 | A1 | 5/2013 | Kobayashi | |

FOREIGN PATENT DOCUMENTS

| | | |
|---|---|---|
| JP | 2004-13584 | 1/2004 |
| JP | 2008217203 | 9/2008 |
| JP | 2012-73168 | 4/2012 |
| JP | 2012-88978 | 5/2012 |
| JP | 2013-97551 | 5/2013 |
| KR | 1020130047658 | 5/2013 |
| TW | 200803131 | 1/2008 |
| TW | 201331738 | 8/2013 |

OTHER PUBLICATIONS

Office Action dated Nov. 2, 2015 from corresponding No. TW 103129145.

Oguey, Henri J., et al., "MOS Voltage Reference Based on Polysilicon Gate Work Function Difference", 1980 IEEE, pp. 264-269.

Office Action dated Jun. 23, 2015 from corresponding No. JP 2014-119682 .

Notice of Allowance dated May 27, 2016 and English translation from corresponding No. KR 10-2014-0165519.

Office Action dated Sep. 11, 2017 from corresponding No. DE 10 2014 103 597.6.

* cited by examiner

FLIPPED GATE VOLTAGE REFERENCE AND METHOD OF USING

BACKGROUND

A voltage reference is a circuit used to provide a reference voltage signal to a circuit. The circuit uses the reference voltage signal as a means of comparison during operation. For example, in voltage regulator applications a feedback signal is compared against the reference voltage in in order to create a regulated output voltage corresponding to a scaled value of the voltage reference.

In some approaches, the voltage reference is formed using bipolar junction transistors (BJTs) to form bandgap references to provide the reference voltage signal. In PNP BJTs the substrate acts as a collector for the BJT rendering the BJT sensitive to majority carrier noise in the substrate. In NPN BJTs the collector is formed as an n-well in a p-type substrate and is susceptible to picking up minority carrier noise from the substrate. Neither NPN BJTs or PNP BJTs allow full isolation from substrate noise.

In some approaches, complementary metal oxide semiconductor (CMOS) devices are used to form the voltage reference. In some instances, the CMOS devices are fabricated in a triple well flow such that every CMOS device is reverse-junction-isolated from the main substrate. In some approaches, a CMOS device includes a polysilicon gate feature which is doped using an opposite dopant type from a dopant in the substrate for the CMOS device.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1:
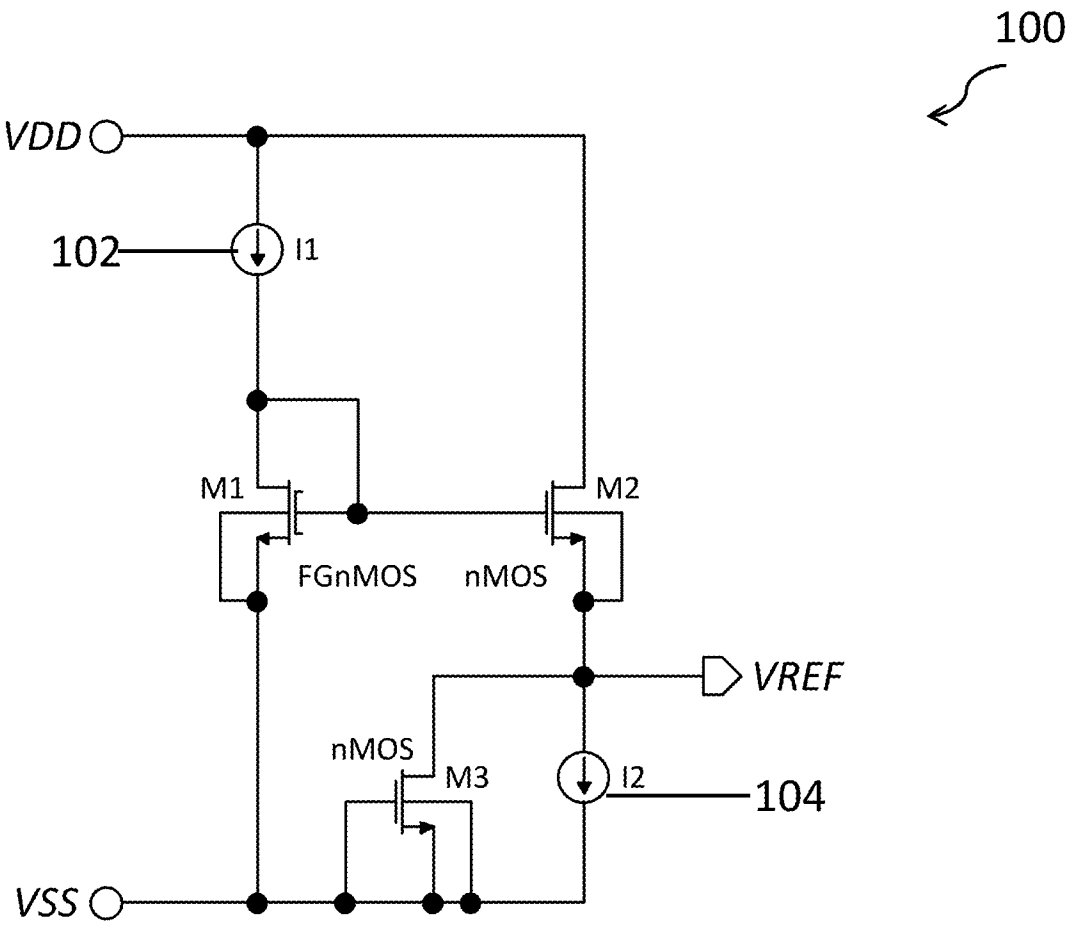
FIG. 1 is a schematic diagram of a voltage reference in accordance with one or more embodiments.

FIG. 1 is a schematic diagram of a voltage reference 100 in accordance with one or more embodiments. Voltage reference 100 includes a flipped gate transistor M1 between an operating voltage VDD and a negative supply voltage VSS. A first current source 102 is configured to supply a first current I1 across flipped gate transistor M1. A transistor M2 is connected between operating voltage VDD and negative supply voltage VSS. Transistor M2 is connected to flipped gate transistor M1 in a Vgs subtractive arrangement. The Vgs subtractive arrangement results from a gate of transistor M2 and flipped gate transistor M1 receiving a same voltage and a source terminal of the flipped gate transistor connected to negative supply voltage VSS. A second current source 104 is configured to supply a second current I2 across transistor M2. A transistor M3 is connected between transistor M2 and negative supply voltage VSS. Each of a gate, a source terminal, and a bulk of transistor M3 are connected to negative supply voltage VSS. An output node for outputting a reference voltage Vref is located between transistor M2 and negative supply voltage VSS and is connected to a drain terminal of transistor M3.

Flipped gate transistor M1 is used to help produce a temperature independent reference voltage Vref. Flipped gate transistor M1 includes a gate electrode which is anti-doped. Anti-doping is a process of doping the gate electrode with a dopant type which is the same as a substrate of flipped gate transistor M1. For example, in a conventional n-type metal oxide semiconductor (NMOS), the substrate is p-doped and the gate electrode is n-doped. However, in a flipped gate NMOS; a portion of the gate electrode is p-doped.

Figure 2:
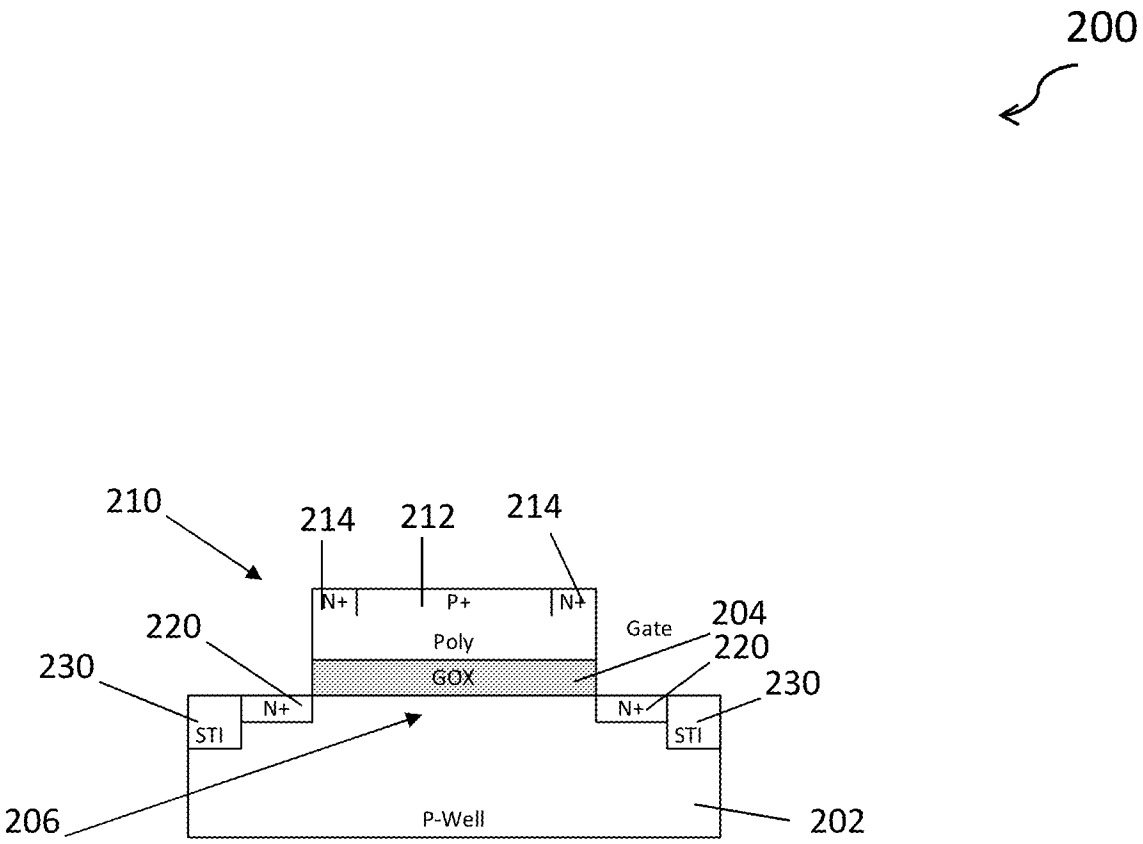
FIG. 2 is a cross sectional view of a flipped gate transistor in accordance with one or more embodiments.

FIG. 2 is a cross sectional view of a flipped gate transistor 200 in accordance with one or more embodiments. Flipped gate transistor 200 is an n-type flipped gate transistor. Flipped gate transistor 200 includes a substrate 202. A gate dielectric layer 204 is over a channel region 206 of substrate 202. A gate electrode 210 is over gate dielectric layer 204. A body region 212 of gate electrode 210 is doped with p-type dopants. Edges 214 of gate electrode 210 are n-doped for self aligned formation of n-doped source/drain (S/D) features 220. Isolation regions 230 are positioned between adjacent flipped gate transistors, in some embodiments. In some embodiments, gate electrode 210 includes doped polysilicon, a metal gate or another suitable gate material. In some embodiments, the p-type dopants include boron, boron di-fluoride, or other suitable p-type dopants. In some embodiments, the n-type dopants include arsenic, phosphorous, or other suitable n-type dopants.

Returning to FIG. 1, the gate of flipped gate transistor M1 is connected to a drain terminal of the flipped gate transistor. A bulk of flipped gate transistor M1 is connected to the source terminal of the flipped gate transistor. In some embodiments, flipped gate transistor M1 is substantially p-doped. Substantially p-doped means that a gate electrode of flipped gate transistor M1 is p-doped except at edges of the gate electrode. The edges of the gate electrode of flipped gate transistor M1 are n-typed to facilitate forming of the drain and source terminals of the flipped gate transistor.

First current source 102 is configured to supply the first current to flipped gate transistor M1. In some embodiments, first current source 102 includes at least one current mirror. In some embodiments, first current source 102 includes a startup device and a current generation device, or another suitable current source.

Transistor M2 is used to help produce the temperature independent reference voltage Vref. Transistor M2 is not a flipped gate transistor. In some embodiments, transistor M2 is a standard NMOS transistor. The gate of transistor M2 is connected to the gate of flipped gate transistor M1. A drain terminal of transistor M2 is connected to operating voltage VDD. A bulk of transistor M2 is connected to the source terminal of the transistor.

Flipped gate transistor M1 has a first size defined by a width and a length of the flipped gate transistor. Transistor M2 has a second size defined by a width and a length of the transistor. The size of transistor M2 is greater than a size of flipped gate transistor M1. The size of transistor M2 is an integer multiple N of the size of flipped gate transistor M1. In some embodiments, the integer multiple N ranges from about 2 to about 50. A size difference between transistor M2 and flipped gate transistor M1 helps determine a temperature dependence of reference voltage Vref. Proper sizing of transistor M2 relative to flipped gate transistor M1 results in a temperature independent reference voltage Vref.

First current source 102 is configured to provide the first current to flipped gate transistor M1. Second current source 104 is configured to provide the second current to transistor M2. A least common denominator current ($I_{LCD}$) is defined based on a ratio of the first current to the second current. For example, a ratio of the first current to the second current being 11:2 results in a least common denominator current of 1. A ratio of the first current to the second current being 8:4 results in a least common denominator current of 4. The first current is a first integer multiple (K1) of the $I_{LCD}$. The second current is also a second integer multiple (K2) of the $I_{LCD}$. The first integer multiple K1 is greater than the second integer multiple K2. In some embodiments, the first integer multiple K1 is about two times greater than the second integer multiple K2. In some embodiments, the first integer multiple K1 is more than two times greater than the second integer multiple K2.

The integer multiple N is determined at least in part by first integer multiple K1 and second integer multiple K2. Tuning of integer multiple N enables adjustment of temperature dependency of reference voltage Vref. Tuning the integer multiple N so that the $\Delta V_{gs}$ of flipped gate transistor M1 and transistor M2 is approximately equal to the bandgap voltage of a semiconductor-based material used in production process used to form voltage reference 100 results in temperature independence of reference voltage Vref.

Transistor M3 is used to remove a channel leakage component of a drain source current running through transistor M2. A size of transistor M3 is equal to a size of transistor M2. Any leakage current through transistor M2 is directed to transistor M3 to help maintain the second current I2 for the purpose of temperature compensation of the reference voltage Vref. The addition of transistor M3 to compensate for leakage through transistor M2 helps to use an entirety of the second current I2 for the purpose of temperature compensation for reference voltage Vref. This leakage cancellation is most effective when the drain-source voltage of M2 is equal to the drain-source voltage of M3, which happens when operating voltage VDD is set at a value given by 2Vref. In approaches that do not include transistor M3, accuracy of the voltage reference rapidly degrades at temperatures above 80° C.

Figure 3:
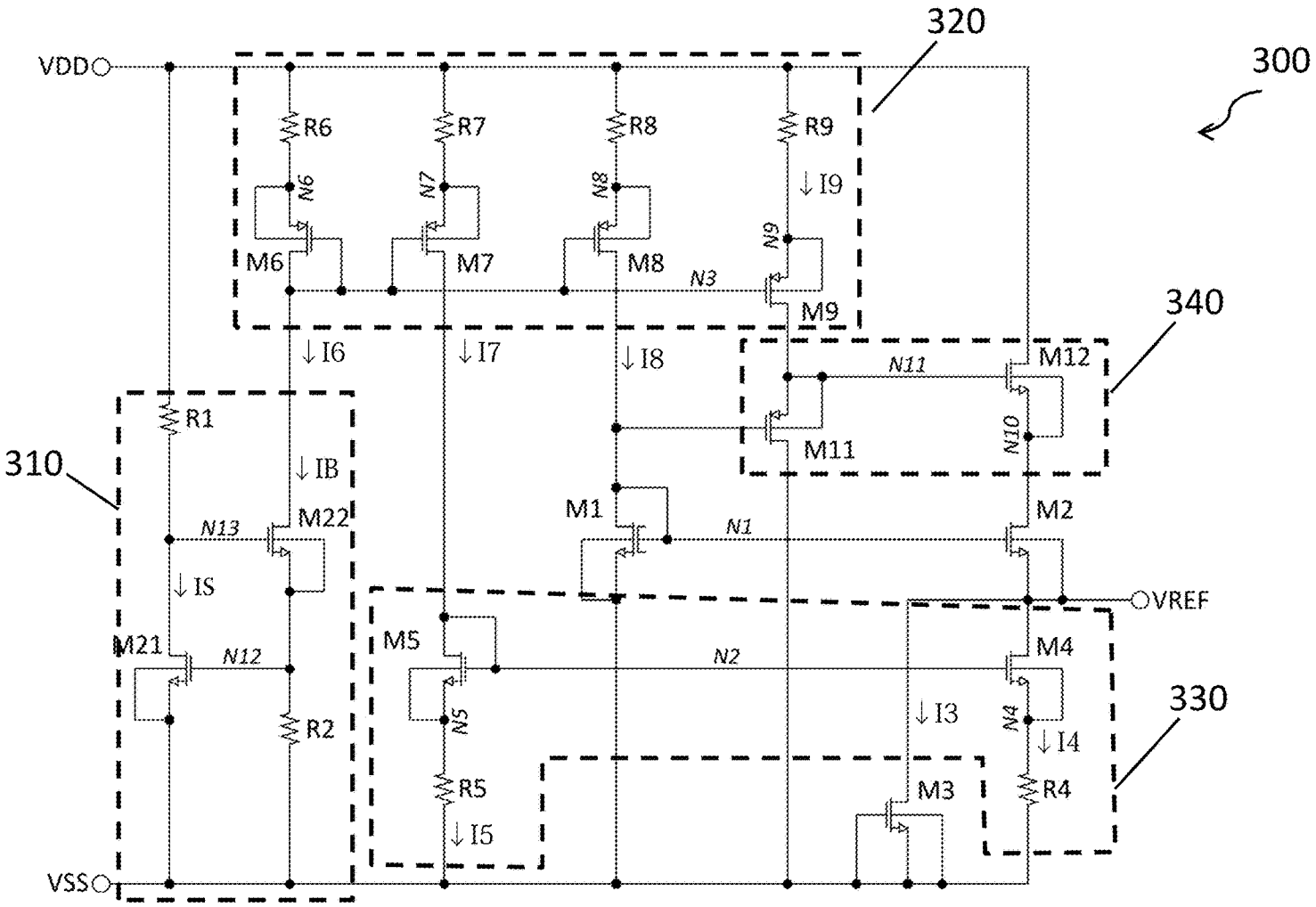
FIG. 3 is a schematic diagram of a voltage reference in accordance with one or more embodiments.

FIG. 3 is a schematic diagram of a voltage reference 300 in accordance with one or more embodiments. Voltage reference 300 includes flipped gate transistor M1, transistor M2 and transistor M3 similar to voltage reference 100. Voltage reference 300 further includes a startup and bias current generator region 310 configured to receive an input voltage and generate a bias current IB. A first current mirror region 320 is configured to generate the first current I1 for flipped gate transistor M1 based on the bias current IB from startup and bias current generator 310. A second current mirror region 330 is configured to receive a mirrored portion IM of the first current I1 and generate the second current I2 for transistor M2. A voltage boxing region 340 is configured to maintain a voltage drop across transistor M2 approximately equal to reference voltage Vref.

Startup and bias current generator region 310 is configured to receive an operating voltage VDD. Startup and bias current generator 310 is connected between the operating voltage VDD and a negative supply voltage VSS. Startup and bias current generator region 310 is configured to generate the bias current IB along a first line connected to first current mirror region 320. First current mirror region 320 is configured to receive the operating voltage VDD. A second line connected to first current mirror region 320 is connected in series to second current mirror 330. A third line connected to first current mirror 320 is connected in series to flipped gate transistor M1. A fourth line connected to first current mirror 320 is connected in series to a first portion of voltage boxing region 340. A second portion of voltage boxing region 340 is serially connected to transistor M2 and second current mirror region 330. In some embodiments, the operating voltage VDD is greater than twice the reference voltage Vref. In some embodiments, negative supply voltage VSS is equal to 0 V. In some embodiments, negative supply voltage VSS is greater or less than 0 V such that operating voltage VDD is always referenced to negative supply voltage VSS.

Startup and bias current generator region 310 is configured to generate the bias current IB for use by voltage reference 300. Startup and bias current generator region 310 includes a startup resistor R1 configured to receive operating voltage VDD. A first bias transistor M21 is connected in series with startup resistor R1. A bias resistor R2 is connected in series to a second bias transistor M22. Bias resistor R2 is connected to negative supply voltage VSS. A gate of first bias transistor M21 is connected to a node between second bias transistor M22 and bias resistor R2. A gate of second bias transistor M22 is connected to a node between startup resistor R1 and first bias transistor M21. A source terminal of first bias transistor M21 is connected to negative supply voltage VSS. A drain terminal of second bias transistor M22 is connected in series with first current mirror region 320. In some embodiments, first bias transistor M21 is an NMOS transistor. In some embodiments, second bias transistor M22 is an NMOS transistor. In some embodiments, first bias transistor M21 and second bias transistor M22 are in a weak inversion state. A weak inversion state means a gate-source voltage Vgs of a transistor is below a threshold voltage of the transistor.

Startup resistor R1 is used to provide a direct path from the operating voltage VDD to the gate of second bias transistor M22 in order to begin operation of voltage reference 300. A voltage across bias resistor R2 is at least partially defined based on a gate-source voltage Vgs of first bias transistor M21. The Vgs of first bias transistor M21 is defined at least in part by a voltage utilized to conduct a startup current IS across startup resistor R1. The startup current IS of voltage reference 300 is provided by the equation VDD−V(N13)/r1, where VDD is the operating voltage, r1 is a corresponding resistance of startup resistor R1, and V(N13) is given by a sum of a gate-source voltage Vgs of first bias transistor M21 and a gate-source voltage Vgs of second bias transistor M22. The bias current IB is conducted across second bias transistor M22 along the first line to current mirror region 320 and is given by the equation V(N12)/r2, where V(N12) is gate-source voltage Vgs of first bias transistor M21 and r2 is a corresponding resistance of bias resistor R2.

First current mirror region 320 is used to provide an integer-ratio multiple of the bias current IB to flipped gate transistor M1. First current mirror region 320 includes a first mirror transistor M6 connected in series with a first mirror resistor R6. First mirror resistor R6 is connected to the operating voltage VDD. First mirror transistor M6 is diode-connected. A drain terminal of first mirror transistor M6 is connected to second bias transistor M22 along the first line. A second mirror transistor M7 is connected in series with a second mirror resistor R7. Second mirror resistor R7 is connected to the operating voltage VDD. A gate of second mirror transistor M7 is connected to a gate of first mirror transistor M6. A drain terminal of second mirror transistor M7 is connected to second current mirror region 330 along the second line. A third mirror transistor M8 is connected in series with a third mirror resistor R8. Third mirror resistor R8 is connected to the operating voltage VDD. A gate of third mirror transistor is connected to the gate of first mirror transistor M6. A drain terminal of third mirror transistor M8 is connected to flipped gate transistor M1 along the third line. A fourth mirror transistor M9 is connected in series with a fourth mirror resistor R9. Fourth mirror resistor R9 is connected to the operating voltage VDD. A gate of fourth mirror transistor M9 is connected to the gate of first mirror transistor M6. A drain terminal of fourth mirror transistor M9 is connected to voltage boxing region 340 along the fourth line. In some embodiments, each of mirror transistor M6, second mirror transistor M7, third mirror transistor M8 and fourth mirror transistor M9 are PMOS transistors.

First current mirror region 320 is configured to receive the bias current IB from startup and bias current generator region 310 along the first line and mirror the bias current IB along the second line, the third line and the fourth line. A size of first mirror transistor M6 is defined as an integer multiple of a first transistor unit size for the first mirror transistor, second mirror transistor M7, third mirror transistor M8 and fourth mirror transistor M9. Second mirror transistor M7, third mirror transistor M8 and fourth mirror transistor M9 independently have a size which is an integer multiple of the first transistor unit size.

A resistance of first mirror resistor R6 is defined based on the bias current IB conducted across first mirror transistor M6 such that the voltage drop across the terminals of R6 is greater than 150 mV. Second mirror resistor R7, third mirror resistor R8 and fourth mirror resistor R9 independently have a resistance which is based on the integer-ratio multiples of the first transistor unit size. By using the first transistor unit size, a current mirrored across each of the mirror transistors of first current mirror region is a ratio of the integer multiples of the relative sizes of the transistors multiplied by a current I6 across the first mirror transistor. A current I7 across second mirror transistor M7 is given by $(n7/n6)\times 16$, where n7 is an integer multiple of the first transistor unit size for second mirror transistor M7, n6 is an integer multiple of the first transistor unit size for first mirror transistor M6, and 16 is the current across the first mirror transistor. A current I8 across third mirror transistor M8 is given by $(n8/n6)\times 16$, where n8 is an integer multiple of the first transistor unit size for third mirror transistor M8. A current I9 across fourth mirror transistor M9 is given by $(n9/n6)\times 16$, wherein n9 is an integer multiple of the first transistor unit size for fourth mirror transistor M9.

By using the first transistor unit size, a resistance across each of the mirror resistors of first current mirror region is a ratio of the integer multiples of the relative sizes of the transistors multiplied by a resistance r6 corresponding to first mirror resistor R6. A resistance r7 corresponding to second mirror resistor R7 is given by $(n6/n7)\times r6$, where n7 is an integer multiple of the first transistor unit size for second mirror transistor M7, n6 is an integer multiple of the first transistor unit size for first mirror transistor M6, and r6 is the resistance corresponding to the first mirror resistor. A resistance r8 corresponding to third mirror resistor R8 is given by $(n6/n8)\times r6$, where n8 is an integer multiple of the first transistor unit size for third mirror transistor M8. A resistance r9 corresponding to fourth mirror resistor R9 is given by $(n6/n9)\times r6$, wherein n9 is an integer multiple of the first transistor unit size for fourth mirror transistor M9.

Adjusting sizes of the mirror transistors M6-M9 and the mirror resistor R6-R9 of first current mirror region 320 enables tuning of the current I8 across flipped gate transistor M1, e.g., first current I1 (FIG. 1), as well as along the other lines of the first current mirror. For example, third mirror transistor M8 and third mirror resistor R8 determine the current I8 across flipped gate transistor M1. In another example, second mirror transistor M7 and second mirror resistor R7 determine the current I7 supplied to second mirror region 330. Tuning of the current I8 across flipped gate transistor M1 helps to increase accuracy and temperature independence of reference voltage Vref output by voltage reference 300. The mirror transistors M6-M9 of first current mirror region 320 are capable of accurately mirroring currents at nano-amp current levels.

Second current mirror region 330 is configured to mirror a current from first current mirror region 320. Second current mirror region 330 includes fifth mirror transistor M5 connected in series with fifth mirror resistor R5. Fifth mirror resistor R5 is connected to negative supply voltage VSS. Fifth mirror transistor M5 is diode-connected. A drain terminal of fifth mirror transistor M5 is connected to second mirror transistor M7 along the second line. Second current mirror region 230 further includes a sixth mirror transistor M4 connected in series with a sixth mirror resistor R4. Sixth mirror resistor R4 is connected to negative supply voltage VSS. A gate of sixth mirror transistor M4 is connected to a gate of fifth mirror transistor M5. A drain terminal of sixth mirror transistor M4 is connected to transistor M2 and to transistor M3 along a fifth line. In some embodiments, each of fifth mirror transistor M5 and sixth mirror transistor M4 are NMOS transistors.

Second current mirror region 330 is configured to receive current I7 from first current mirror region 320 along the second line and mirror current I7 along the fifth line. A size of fifth mirror transistor M5 is defined as an integer multiple of a second transistor unit size. Sixth mirror transistor M4 has a size which is an integer multiple of the second transistor unit size. In some embodiments, the first transistor unit size is equal to the second transistor unit size. In some embodiments, the first transistor unit size is different from the second transistor unit size.

A resistance of fifth mirror resistor R5 is defined based on the current I5 conducted across fifth mirror transistor M5 such that the voltage drop across the terminals of R5 is greater than 150 mV. Sixth mirror resistor R4 has a resistance which based on the integer multiples of the second transistor unit size.

By using the second transistor unit size, a current mirrored across each of the mirror transistors of second current mirror region 330 is a ratio of the integer multiples of the relative sizes of the transistors multiplied by a current I5 across fifth mirror transistor M5. A current I4 across sixth mirror transistor M4 is given by $(n4/n5)\times I5$, where n4 is an integer multiple of the second transistor unit size for sixth mirror transistor M4, n5 is an integer multiple of the second transistor unit size for fifth mirror transistor M5, and I5 is the current across the fifth mirror transistor.

By using the second transistor unit size, a resistance across each of the mirror resistors of second current mirror region 330 is a ratio of the integer multiples of the relative sizes of the transistors multiplied by a resistance r5 corresponding to fifth mirror resistor R5. A resistance r4 corresponding to sixth mirror resistor R4 is given by (n5/n4)×r5, where n4 is an integer multiple of the second transistor unit size for sixth mirror transistor M4, n5 is an integer multiple of the second transistor unit size for fifth mirror transistor M5, and r5 is the resistance corresponding to the fifth mirror resistor.

Adjusting sizes of the mirror transistors M5 and M4 as well as the mirror resistor R5 and R4 of second current mirror region 330 enables tuning of the current across transistor M2, e.g., second current I2 (FIG. 1). For example, sixth mirror transistor M4 and sixth mirror resistor R4 determine the current I2 across transistor M2. Tuning of the current across transistor M2 helps to increase accuracy and temperature independence of reference voltage Vref output by voltage reference 300. The mirror transistors M5 and M4 of second current mirror region 330 are capable of accurately mirroring currents at nano-amp current levels due to the use of mirror degeneration resistors R4 and R5.

Voltage boxing region 340 is configured to maintain a voltage drop across transistor M2 approximately equal to reference voltage Vref. Voltage boxing region 340 includes a first boxing transistor M11. A source terminal of first boxing transistor M11 is configured to receive a current I9 from first current mirror region 320 along the fourth line. A gate of first boxing transistor M11 is connected to flipped gate transistor M1 and is configured to receive current I8, which is equivalent to current I1. A drain terminal of first boxing transistor M11 is connected to the negative supply voltage VSS. In some embodiments, first boxing transistor M11 is a PMOS transistor. Voltage boxing region 340 further includes a second boxing transistor M12. A source terminal of second boxing transistor M12 is connected to transistor M2 along the fifth line. A drain terminal of second boxing transistor M12 is connected to the operating voltage VDD. A gate of second boxing transistor is connected to a source terminal of first boxing transistor M11 and is configured to receive current I9. In some embodiments, second boxing transistor M12 is an NMOS transistor.

First boxing transistor M11 is a level-shifting source follower. First boxing transistor is biased by current I9 from first current mirror region 320. First boxing transistor M11 is configured to perform level-shifting in a direction of the operating voltage VDD. Second boxing transistor M12 is also a level-shifting source follower. Second boxing transistor M12 is biased by the current across transistor M2. The current across transistor M2 is less than current I9 from first current mirror region 320. Second boxing transistor M12 is configured to perform level-shifting in a direction of the negative supply voltage VSS.

First boxing transistor M11 has a size less than a size of second boxing transistor M12. A level-shift from the gate of first boxing transistor M11 to the source terminal of second boxing transistor M12 is a positive value, due to the size difference between the first boxing transistor and the second boxing transistor as well as the current difference between current I9 and the current across transistor M2. The positive value of the level-shifting to the source terminal of second boxing transistor M12 helps to provide a voltage level at the source terminal of the second boxing transistor suitable to approximately match a leakage current of transistor M2 to a leakage current I3 of transistor M3. By matching the leakage current of transistor M2 to the leakage current I3 of M3, reference voltage Vref output by voltage reference 300 is maintained at a constant level for all temperature values, i.e., reference voltage Vref is temperature independent. In some embodiments, a voltage level at the source terminal of second boxing transistor M12 is approximately equal to twice (2Vref) the reference voltage Vref.

Figure 4:
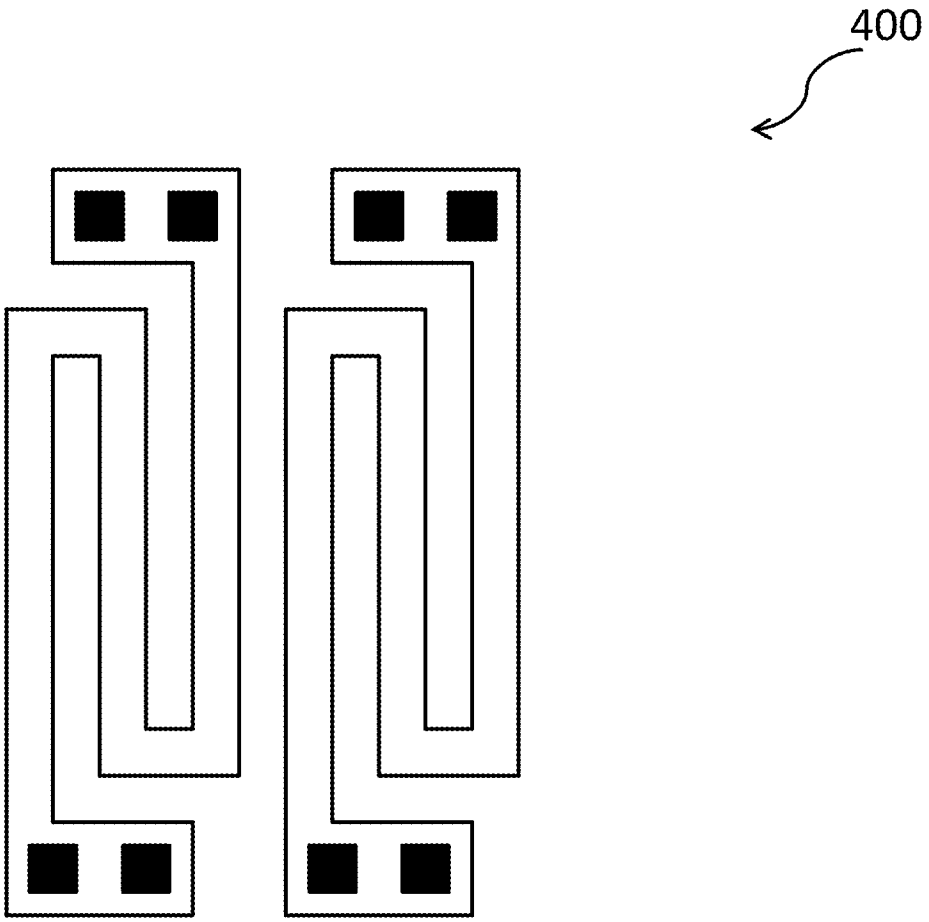
FIG. 4 is a top view of a resistor arrangement in accordance with one or more embodiments.

FIG. 4 is a top view of a resistor arrangement 400 in accordance with one or more embodiments. Resistor arrangement 400 has a serpentine structure. Resistor arrangement 400 includes polysilicon, thin film silicon chromium or another suitable resistive material. A minimum width of the polysilicon in resistor arrangement 400 is defined by a critical dimension of a formation process. The critical dimension is a smallest dimension which can reliably be formed using the formation process. In some embodiments, resistor arrangement 400 is formed using a lithography process. By including the serpentine structure and width based on the critical dimension, resistor arrangement 400 has a higher resistance per unit area in comparison with other approaches which use wider elements or straight-line layouts. In some embodiments, a resistance of resistor arrangement 400 is on the order of 1 Mega Ohm (MΩ) or greater. In some embodiments, resistor arrangement 400 is used as a resistor unit size for resistors in a voltage reference, e.g., voltage reference 300 (FIG. 3). For example, if resistance r6 corresponding to first mirror resistor R6 is 3 MΩ and the unit resistor size of resistor arrangement 400 is 1 MΩ, the first mirror resistor is formed using three serial connected resistor arrangements, in some embodiments. The voltage drop across resistor arrangement 400 is set at a sufficiently high level to provide current matching in a current mirror, e.g., first current mirror region 320 or second current mirror region 330 (FIG. 3), and to enable the formation of accurate current mirrors at nanopower levels. In some embodiments, a voltage drop across resistor arrangement 400 is equal to or greater than 150 millivolts (mV). In some embodiments, at least one resistor of mirror resistors R4-R9 is formed having resistor arrangement 400. In some embodiments, all mirror resistors R4-R9 are formed having resistor arrangement 400. Due to the use of nanopower levels, resistances of resistors in voltage reference 300 are set as high as possible, in some embodiments.

Figure 5:
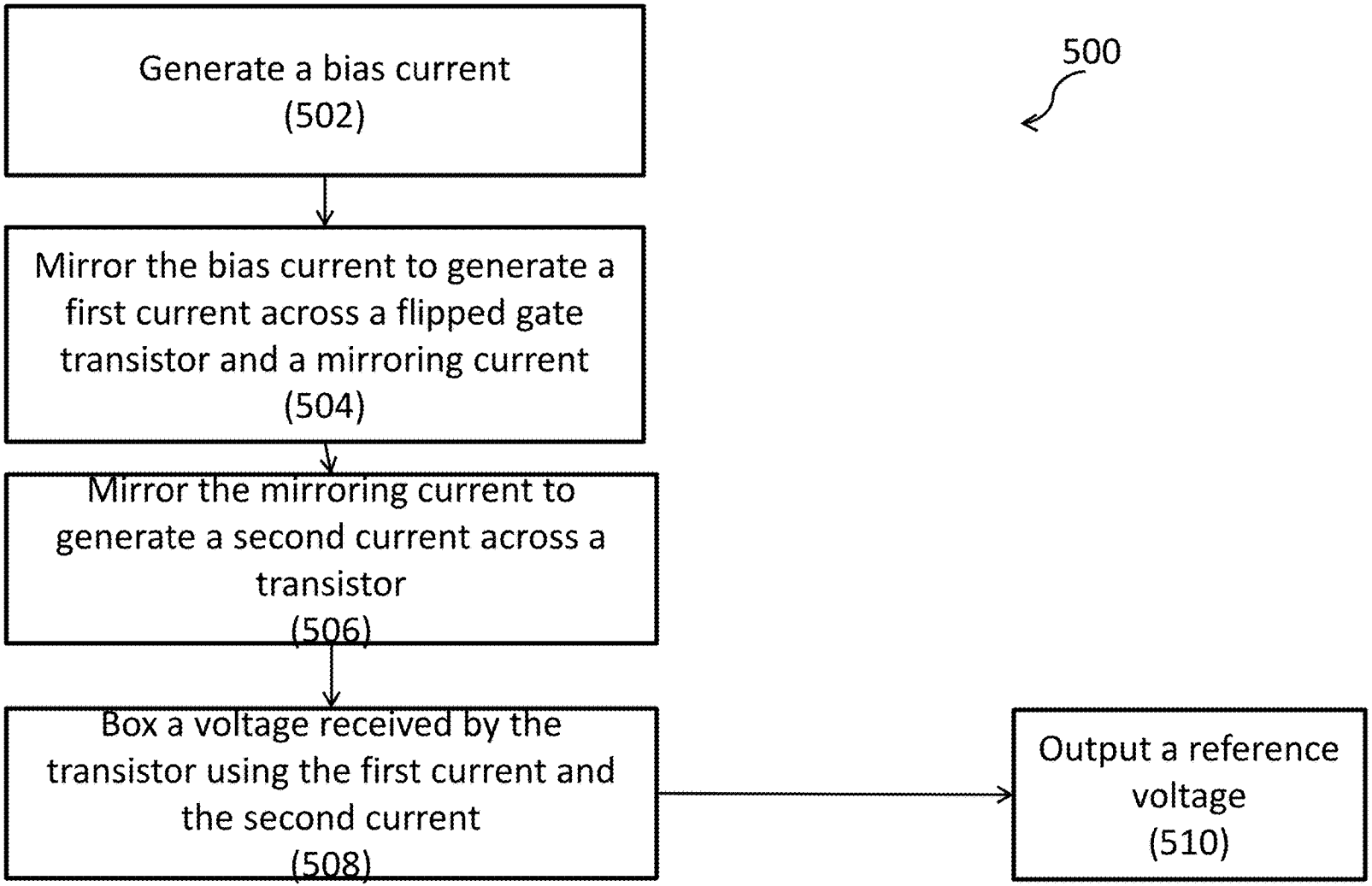
FIG. 5 is a flow chart of a method of using a voltage reference in accordance with one or more embodiments.

FIG. 5 is a flowchart of a method 500 of using a voltage reference in accordance with one or more embodiments. Method 500 begins with operation 502 in which a bias current is generated. In some embodiments, the bias current is generated using a startup and bias current generator, e.g., startup and bias current generator region 310 (FIG. 3). The bias current provides a basis for scaling of other currents throughout the voltage reference, e.g., voltage reference 100 (FIG. 1) or voltage reference 300. In some embodiments, the startup current is generated based on an operating voltage, e.g., operation voltage VDD, of the voltage reference. In some embodiments, the bias current is generated based on a gate source voltage of a bias transistor, e.g., first bias transistor M21, divided by a resistance across a bias resistor, e.g., bias resistor R2.

Method 500 continues with operation 504 in which the bias current is mirrored to generate a first current across a flipped gate transistor and a mirroring current. The first current across the flipped gate transistor, e.g., flipped gate transistor M1 (FIGS. 1 and 2), is determined based on a transistor unit size, e.g., the first transistor unit size. In some embodiments, the bias current is mirrored using a first current mirror, e.g., first current mirror region 320 (FIG. 3). In some embodiments, a ratio between the first current and the bias current is selected by adjusting the sizes of mirroring transistors and mirroring resistors within the first current mirror. The mirroring current is generated along a different line from the first current. In some embodiments, the mirroring current is equal to the first current. In some embodiments, the mirroring current is different from the first current.

In operation 506 the mirroring current is mirrored to generate a second current across a transistor. The first current is based on a ratio of integer multiples of a transistor unit size, e.g., the second transistor unit size, across the transistor, e.g., transistor M2 (FIGS. 1 and 3). In some embodiments, the first current is mirrored using a second current mirror, e.g., second current mirror 330 (FIG. 3). In some embodiments, a ratio between the first current and the second current is selected by adjusting the sizes of mirror transistors and mirror resistors within the second current mirror. In some embodiments, the first current is twice the second current. In some embodiments, the flipped gate transistor receiving the first current is smaller than the transistor receiving the second current.

Method 500 continues with operation 508 in which a voltage received by the transistor is boxed using the first current and the second current. The voltage is boxed to compensate for leakage current across the transistor. In some embodiments, the voltage is boxed using a voltage boxing circuit, e.g., voltage boxing region 340 (FIG. 3). In some embodiments, the voltage boxing circuit includes dual source followers. In some embodiments, the voltage is boxed so that a voltage received by the flipped gate transistor is less than a voltage received by the transistor receiving the second current.

In operation 510 a reference voltage is output. The reference voltage, e.g., reference voltage Vref (FIGS. 1 and 3), is temperature independent. The reference voltage is usable by external circuitry for performing comparisons. In some embodiments, the reference voltage is less than half of the operating voltage of the voltage reference.

One of ordinary skill in the art would recognize that additional operations are able to be included in method 500, that operations are able to be omitted, and an order of operations are able to be re-arranged without departing from the scope of this description.

One aspect of this description relates to a voltage reference including a flipped gate transistor configured to receive a first current. The voltage reference further includes a first transistor configured to receive a second current, the first transistor having a first leakage current, wherein the first transistor is connected with the flipped gate transistor in a Vgs subtractive arrangement. The voltage reference further includes an output node configured to output a reference voltage, the output node connected to the first transistor. The voltage reference further includes a second transistor connected to the output node, the second transistor having a second leakage current, wherein the first leakage current is substantially equal to the second leakage current.

Another aspect of this description relates to a voltage reference including a first current mirror region configured to receive a bias current and to generate a first current and a mirroring current. The voltage reference further includes a second current mirror region configured to receive the mirroring current and to generate a second current. The voltage reference further includes a flipped gate transistor configured to receive the first current. The voltage reference further includes a first transistor configured to receive the second current, a gate of the first transistor connected to the flipped gate transistor, wherein the first transistor has a first leakage current. The voltage reference further includes an output node configured to output a reference voltage, the output node connected to the first transistor. The voltage reference further includes a second transistor connected to the output node, the second transistor having a second leakage current, wherein the first leakage current is substantially equal to the second leakage current. Still another aspect of this description relates to a method of using a voltage reference. The method includes generating a bias current, and mirroring this current to generate a first current across a flipped gate transistor and to generate a mirroring current. The method further includes mirroring the mirroring current to generate a second current across a first transistor, the first transistor having a first leakage current. The method further includes compensating for the first leakage current using a second transistor, the second transistor having a second leakage current substantially equal to the first leakage current, and outputting a reference voltage.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A voltage reference comprising:

a flipped gate transistor configured to receive a first current from a first current source, a first terminal and a gate of the flipped gate transistor being connected to a first voltage node, and the flipped gate transistor being connected between the current source and a second voltage node;

an output node configured to output a reference voltage;

a first transistor configured to receive a second current, the first transistor having a first leakage current, wherein a gate of the first transistor is connected to the first voltage node, and the first transistor is connected between the first voltage node and the output node; and a second transistor connected between the second voltage node and the output node, the second transistor having a second leakage current, wherein the voltage reference is configured to offset the first leakage current by adding the second leakage current to the second current.

2. The voltage reference of claim 1, wherein a size of the flipped gate transistor is less than a size of the first transistor.

3. The voltage reference of claim 1, wherein a size of the first transistor is a first integer multiple of a transistor unit size, and a size of the flipped gate transistor is a second integer multiple of the transistor unit size.

4. The voltage reference of claim 1, wherein the first current is greater than the second current.

5. The voltage reference of claim 1, wherein the flipped gate transistor is an n-type metal oxide semiconductor (NMOS) transistor, the first transistor is an NMOS transistor, and the second transistor is an NMOS transistor.

6. The voltage reference of claim 1, wherein the first current source comprises a first current mirror circuit configured to receive a bias current and to generate the first current and a mirroring current; and the voltage reference comprises a second current mirror circuit configured to receive the mirroring current and to generate the second current.

7. The voltage reference of claim 6, further comprising a bias current generator configured to receive an operating voltage and to generate the bias current.

8. The voltage reference of claim 1, further comprising a voltage boxing circuit configured to offset the first leakage current with the second leakage current.

9. A voltage reference comprising:

a first current mirror circuit configured to receive a first bias current and to generate a first current and a mirroring current;

a second current mirror circuit configured to receive the mirroring current as a second bias current and to generate a second current;

a flipped gate transistor configured to receive the first current;

a first transistor configured to receive the second current, a gate of the first transistor connected to a gate of the flipped gate transistor, wherein the first transistor has a first leakage current;

an output node configured to output a reference voltage, the output node connected to the first transistor; and a second transistor connected to the output node, the second transistor having a second leakage current, wherein the voltage reference is configured to offset first leakage current with the second leakage current.

10. The voltage reference of claim 9, further comprising a voltage boxing circuit configured to receive the first current and the second current and to offset the first leakage current with the second leakage current.

11. The voltage reference of claim 10, wherein:

the first current mirror circuit is further configured to generate a third current; and the voltage boxing circuit comprises:

a first source follower transistor connected between the first current mirror circuit and the second current mirror circuit, a gate of the first source follower transistor being configured to receive the first current, and a second source follower transistor, a gate of the second source follower transistor being connected to a source of the first source follower transistor, and a source of the second source follower transistor being configured to receive the second current.

12. The voltage reference of claim 11, wherein the gate of the first source follower transistor is connected to the flipped gate transistor, and a source terminal of the second source follower transistor is connected to the first transistor.

13. The voltage reference of claim 9, further comprising a first bias current generator circuit configured to receive an operating voltage and to generate the first bias current.

14. The voltage reference of claim 9, wherein the first current mirror circuit is configured to receive the first bias current along a first line, the second current mirror circuit is configured to receive the mirroring current along a second line separate from the first line, and the flipped gate transistor is configured to receive the first current along a third line separate from the first line and the second line.

15. The voltage reference of claim 14, wherein the first current mirror circuit comprises:

a first mirror transistor configured to receive the first bias current;

a first mirror resistor connected in series with the first mirror transistor;

a second mirror transistor configured to mirror the first bias current and to generate the mirroring current;

a second mirror resistor connected in series with the second mirror transistor;

a third mirror transistor configured to mirror the first bias current and to generate the first current;

a third mirror resistor connected in series with the third mirror transistor;

a fourth mirror transistor configured to mirror the first bias current and to maintain the first leakage current substantially equal to the second leakage current; and a fourth mirror resistor connected in series with the fourth mirror transistor.

16. The voltage reference of claim 15, wherein the second current mirror circuit comprises:

a fifth mirror transistor configured to receive the second bias current;

a fifth mirror resistor connected in series with the fifth mirror transistor;

a sixth mirror transistor configured to mirror the mirroring current and to generate the second current; and a sixth mirror resistor connected in series with the sixth mirror transistor.

17. The voltage reference of claim 16, wherein a size of the fifth mirror transistor is different from a size of the sixth mirror transistor.

18. The voltage reference of claim 15, wherein a size of the first mirror transistor is different from a size of each of the second mirror transistor, the third mirror transistor, and the fourth mirror transistor.

19. A method of using a voltage reference, the method comprising:

generating a first bias current;

mirroring the first bias current to generate a first current across a flipped gate transistor and to generate a mirroring current;

receiving the mirroring current as a second bias current;

mirroring the second bias current to generate a second current across a first transistor, the first transistor having a first leakage current;

compensating for the first leakage current using a second transistor, the second transistor having a second leakage current; and outputting a reference voltage.

20. The method of claim 19, wherein compensating for the first leakage current comprises boxing a voltage received by the first transistor based on the first current and the second current, such that a voltage drop across the first transistor is approximately equal to the reference voltage.

* * * * *